US011015381B2

(12) United States Patent
Enns

(10) Patent No.: US 11,015,381 B2
(45) Date of Patent: May 25, 2021

(54) BI-FOLD DOOR ASSEMBLY WITH FOLDING TRUSS

(71) Applicant: John L. Enns, La Salle (CA)

(72) Inventor: John L. Enns, La Salle (CA)

( * ) Notice: Subject to any disclaimer, the term of this patent is extended or adjusted under 35 U.S.C. 154(b) by 215 days.

(21) Appl. No.: 16/005,989

(22) Filed: Jun. 12, 2018

(65) Prior Publication Data

US 2019/0093419 A1 Mar. 28, 2019

Related U.S. Application Data

(60) Provisional application No. 62/518,369, filed on Jun. 12, 2017.

(51) Int. Cl.

| | |
|---|---|
| ***E06B 3/48*** | (2006.01) |
| ***E06B 7/28*** | (2006.01) |
| *E06B 3/01* | (2006.01) |
| *E06B 5/12* | (2006.01) |

(52) U.S. Cl.

CPC ..... *E06B 3/483* (2013.01); *E06B 7/28* (2013.01); *E06B 3/01* (2013.01); *E06B 5/12* (2013.01)

(58) Field of Classification Search

CPC ..... E06B 3/48; E06B 3/485; E06B 3/5009; E06B 9/06; E06B 9/0669; E05D 15/264; E05D 15/26; E05D 15/262; E05C 19/003

See application file for complete search history.

(56) References Cited

U.S. PATENT DOCUMENTS

| | | | | |
|---|---|---|---|---|
| 4,637,446 | A * | 1/1987 | McQueen | E05D 15/262 160/207 |
| 6,250,361 | B1 * | 6/2001 | Ochoa | E05D 15/24 16/96 R |
| 6,659,157 | B1 * | 12/2003 | Suderman | E06B 3/01 160/213 |
| 9,523,233 | B2 * | 12/2016 | Keller | E06B 3/38 |
| 10,208,529 | B2 * | 2/2019 | Betker | E06B 1/522 |
| 2006/0038468 | A1 * | 2/2006 | Morgan | A47B 96/16 312/245 |
| 2010/0287727 | A1 * | 11/2010 | Suderman | E05D 15/264 16/2.1 |

* cited by examiner

*Primary Examiner* — Johnnie A. Shablack
*Assistant Examiner* — Jeremy C Ramsey
(74) *Attorney, Agent, or Firm* — Ryan W. Dupuis; Kyle R. Satterthwaite; Ade & Company Inc.

(57) ABSTRACT

A bi-fold door assembly has an upper door section and a lower door section connected by a hinge such that the upper and lower door sections are movable between a closed position spanning the door opening and an open position in which the upper door section is oriented transversely to the door opening and the lower door section is folded upwardly towards an inner side of the upper door section. A truss supported along the inner side of one of the upper and lower door sections is movable relative to the door sections between a first position in which the truss stiffens the door assembly against bending corresponding to the closed position of the door sections and a second position in which the truss member is reduced in overall width relative to said one of the upper and lower door sections in a normal direction to the door sections.

20 Claims, 5 Drawing Sheets

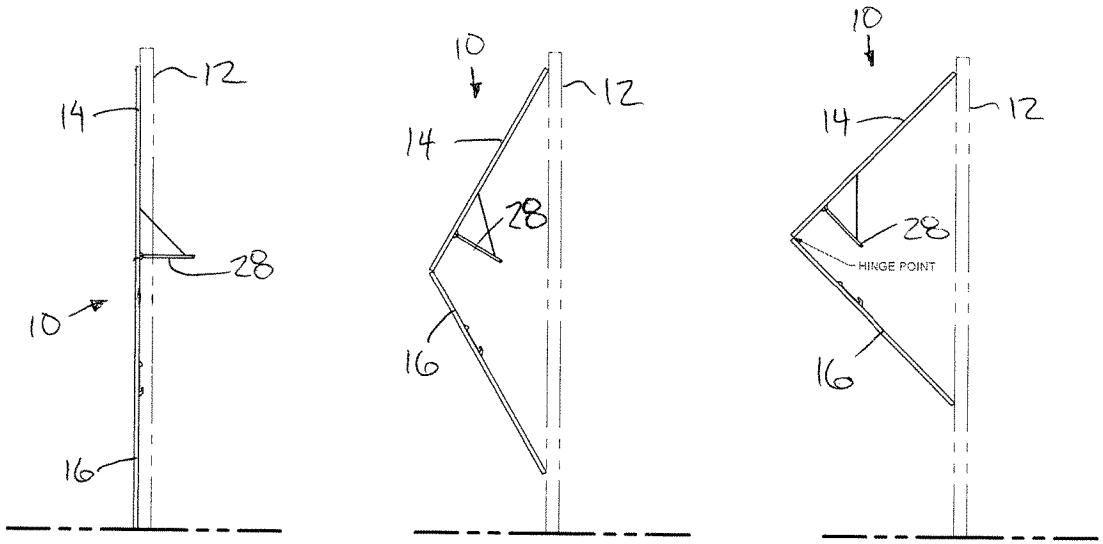
FIG. 9
FIG. 10
FIG. 11
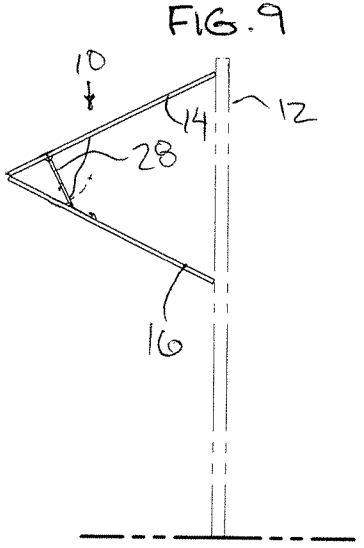
FIG. 12
FIG. 13
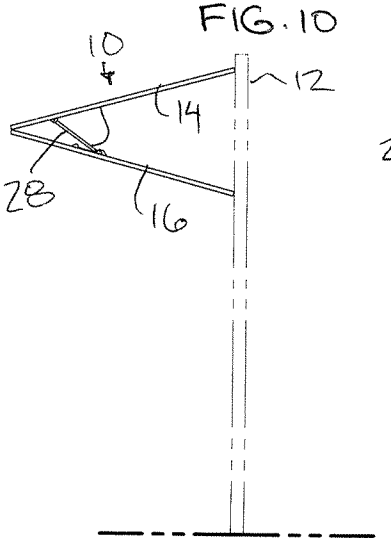
FIG. 14
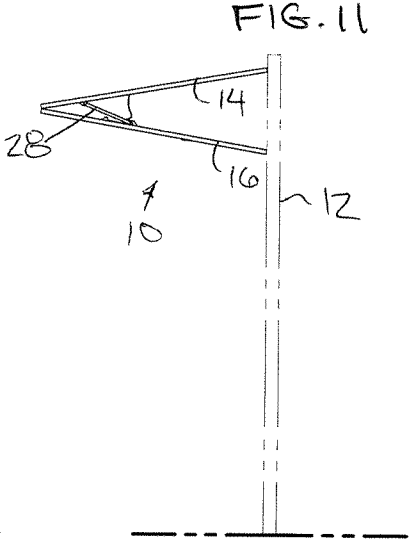
FIG. 15

BI-FOLD DOOR ASSEMBLY WITH FOLDING TRUSS

This application claims the benefit under 35 U.S.C. 119(e) of U.S. provisional application Ser. No. 62/518,369, filed Jun. 12, 2018.

FIELD OF THE INVENTION

The present invention relates to a bi-fold door assembly for a building including an upper leaf pivotally coupled to the building above a door opening and a lower leaf hinged to the upper leaf about a horizontal hinge axis, and more particularly the present invention relates to a bi-fold door assembly having a truss along an inner side of one of the leaves to resist bending of the door in the closed position in which the truss is foldable relative to leaf in the open position so as not to interfere with folding of the leaves relative to one another into the closed position.

BACKGROUND

The use of bi-fold doors are commonly used on buildings to span large door openings, for example of airplane hangars or barns for storing large agricultural equipment and the like. Examples of bi-fold doors can be found in U.S. Pat. No. 6,659,157 by Suderman, U.S. Pat. No. 2,936,830 by Mosher, U.S. Pat. No. 4,545,418 by List et al, U.S. Pat. No. 4,637,446 by McQueen et al and 2008/0086947 by Crown. A typical overhead bi-fold door includes an upper leaf hinged to the building along an upper edge of the door opening and a lower leaf hinged to a bottom end of the upper leaf such that the leaves are pivotal between a closed position lying in a common plane to span the door opening of the building and an open position in which the leaves are folded relative to one another so that the door opening is mostly unobstructed by the leaves.

In some instance, a truss is provided along an inner side of one or both of the leaves as shown in Suderman noted above. The truss is typically required to provide resistance to bending of the door under wind loads when closed, but the overall size and placement of the trusses are limited so that the trusses do not interfere with folding of the door into the open position.

SUMMARY OF THE INVENTION

According to one aspect of the invention there is provided a bi-fold door assembly for a door opening in a building, the assembly comprising:

an upper door section for being pivotally coupled at a top end of the upper door section to the building at a top of the door opening;

a lower door section;

a hinge pivotally coupling a top end of the lower door section to a bottom end of the upper door section such that the upper and lower door sections are movable between a closed position spanning the door opening and an open position in which the upper door section is oriented transversely to the door opening and the lower door section is folded upwardly towards an inner side of the upper door section;

a truss supported along the inner side of one of the upper and lower door sections in proximity to the hinge;

the truss being movable relative to said one of the upper and lower door sections between a first position in which the truss stiffens the door assembly against bending corresponding to the closed position of the door sections and a second position in which the truss member is reduced in overall width relative to said one of the upper and lower door sections in a direction which is normal to said one of the upper and lower door sections corresponding to the open position of the door sections.

The configuration of the truss to be movable relative to the door sections as the door sections are pivoted to the open folded position allows both the size of the truss to be maximized and the placement of the truss near the hinge or near the center of the door to be optimized for strength to resist bending in the closed position of the door, while at the same time enables the door sections to be folded relative to one another into the open position without interference by the truss.

The truss is preferably pivotal relative to said one of the upper and lower door sections about a truss axis oriented parallel to an axis of the hinge between the first position and the second position thereof.

Preferably, the truss is supported on the upper door section. In this instance, the truss is preferably folded upwardly towards the top end of the upper door section from the first position to the second position.

A flexible tension member may be operatively connected between the truss and said one of the upper and lower door sections so as to be arranged to be supported under tension to restrict movement of the door assembly in the first position in a direction away from the second position without resisting displacement of the truss from the first position to the second position.

The truss is preferably biased by gravity from the second position towards the first position in the closed position of the door sections.

Preferably the truss is urged from the first position to the second position by engagement with the other one of the upper and lower door sections as the door sections are folded towards the open position. In this instance, a roller may be supported on the truss for rolling engagement along said other one of the upper and lower door sections to urge the truss from the first position to the second position.

When the truss comprises an outer cord and a plurality of web members connected between the outer cord and said one of the upper and lower door sections, preferably each web member being pivotally coupled relative to said one of the upper and lower door sections by a respective hinge element such that the truss is pivotal relative to the door sections between the first and second positions thereof. Furthermore, each web member is preferably connected between the outer cord and said one of the upper and lower door sections so as to be perpendicular to said one of the upper and lower door sections in the first position.

The overall width of the truss in the direction which is normal to said one of the upper and lower door sections may be considerably greater than a distance along said one of the upper and lower door sections between the truss and the hinge, for example the width may be 2, 3, 4 or more times greater than the distance.

The truss may span most of a length of the door sections between opposing side edges of the bi-fold door, and more preferably spans the full length of the door sections.

One embodiment of the invention will now be described in conjunction with the accompanying drawings in which:

BRIEF DESCRIPTION OF THE DRAWINGS

FIGS. 9 through 15 are side elevational views of the bi-fold door assembly including the folding truss according to the present invention supported thereon through a range of positions between a closed position in FIG. 9 to a fully open position in FIG. 15.

In the drawings like characters of reference indicate corresponding parts in the different figures.

DETAILED DESCRIPTION

Figure 2:
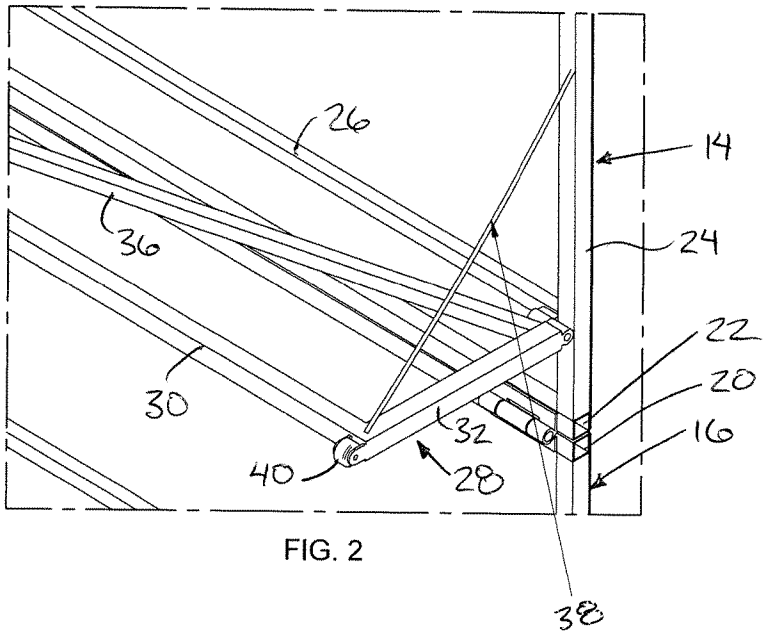
FIG. 2 is an enlarged portion of one of the hinges coupling the folding truss to the bi-fold door assembly in FIG. 1.
Figure 1:
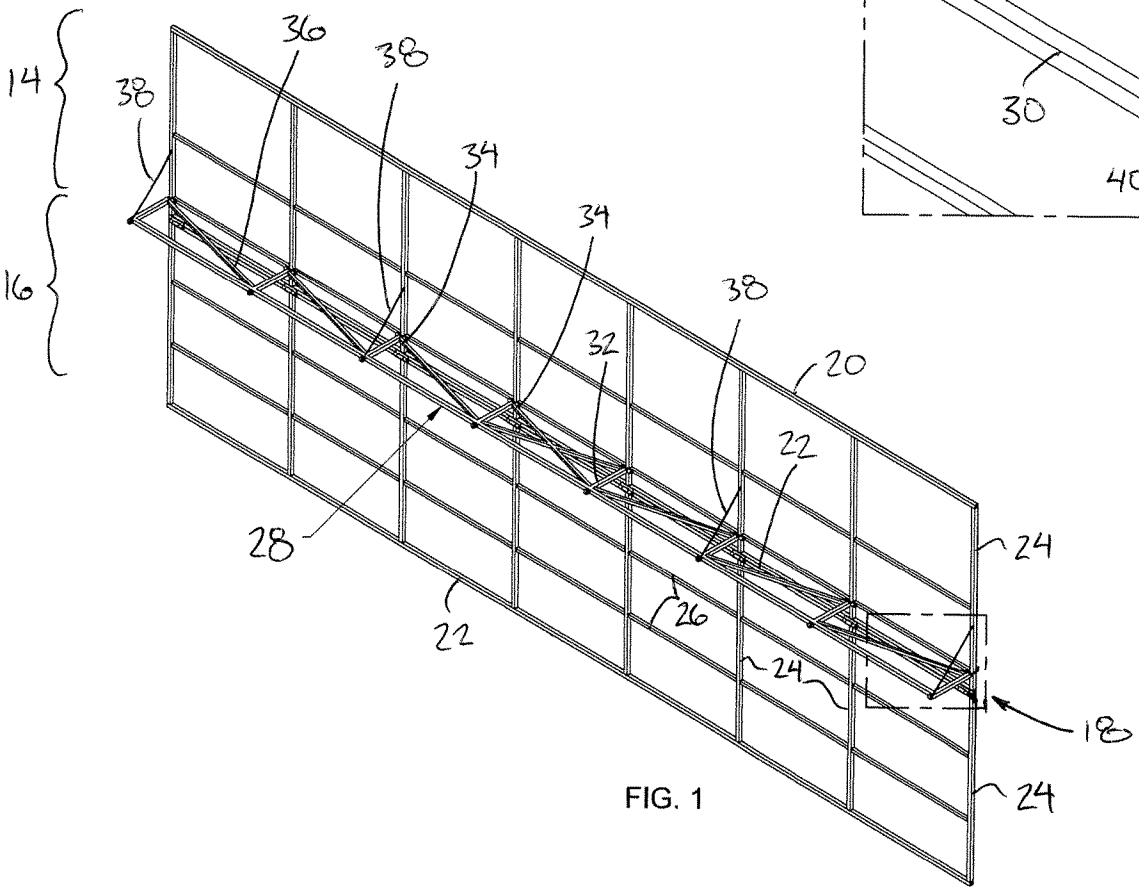
FIG. 1 is a perspective view of a bi-fold door assembly in a closed position including a folding truss according to the present invention supported thereon.
Figure 4:
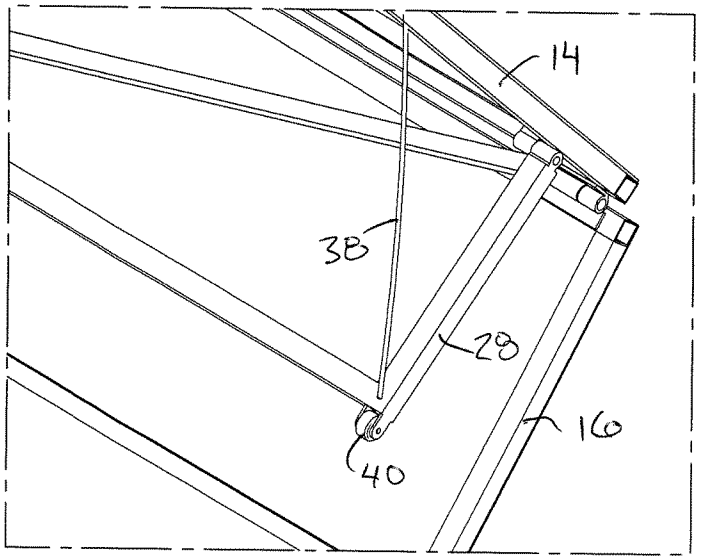
FIG. 4 is an enlarged portion of one of the hinges coupling the folding truss to the bi-fold door assembly in FIG. 3.
Figure 3:
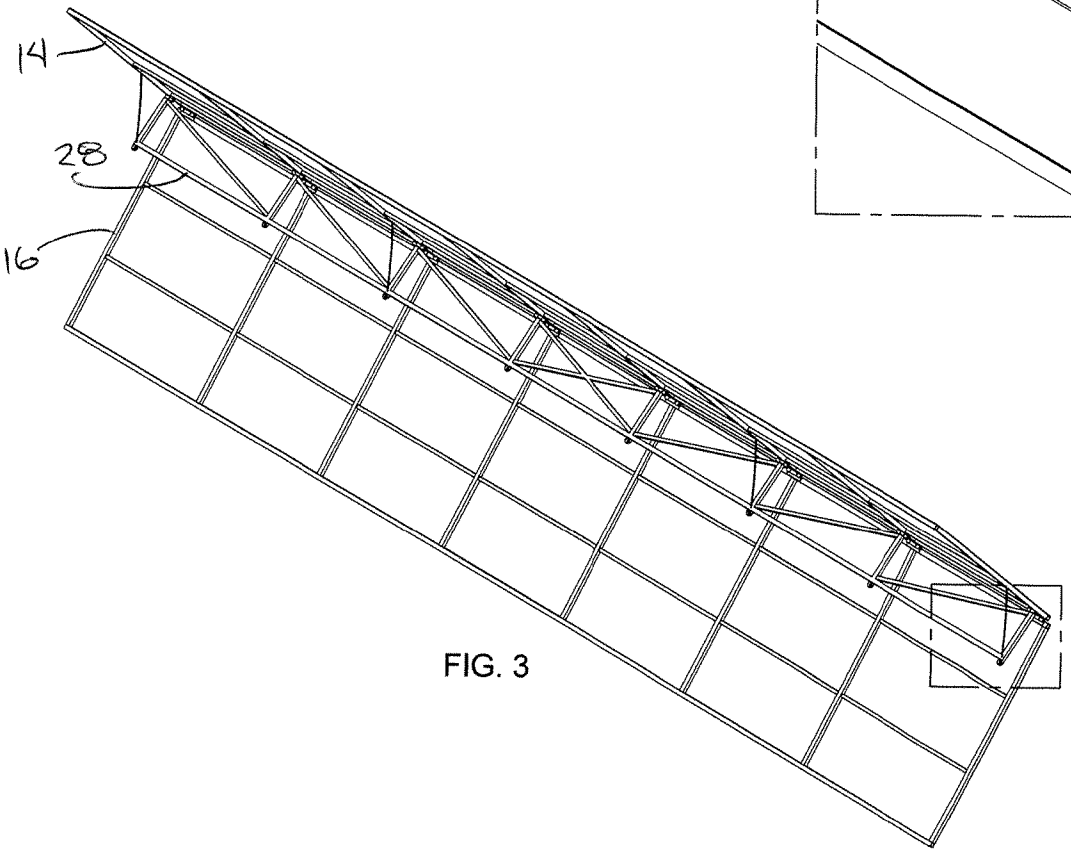
FIG. 3 is a perspective view of the bi-fold door assembly in a partially open position at 40 degrees from vertical including the folding truss according to the present invention supported thereon.
Figure 6:
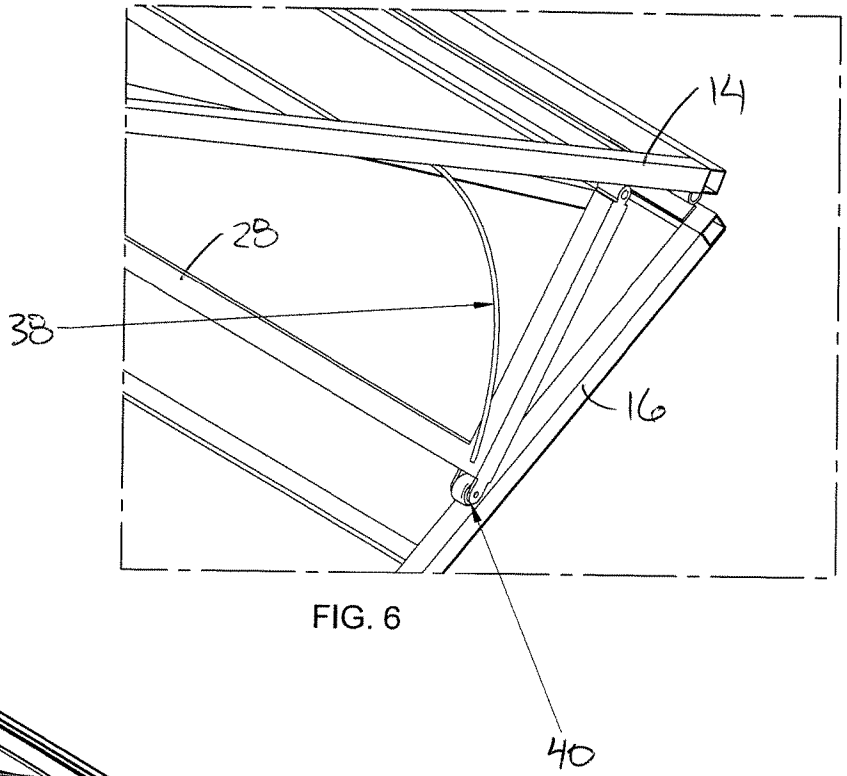
FIG. 6 is an enlarged portion of one of the hinges coupling the folding truss to the bi-fold door assembly in FIG. 5.
Figure 5:
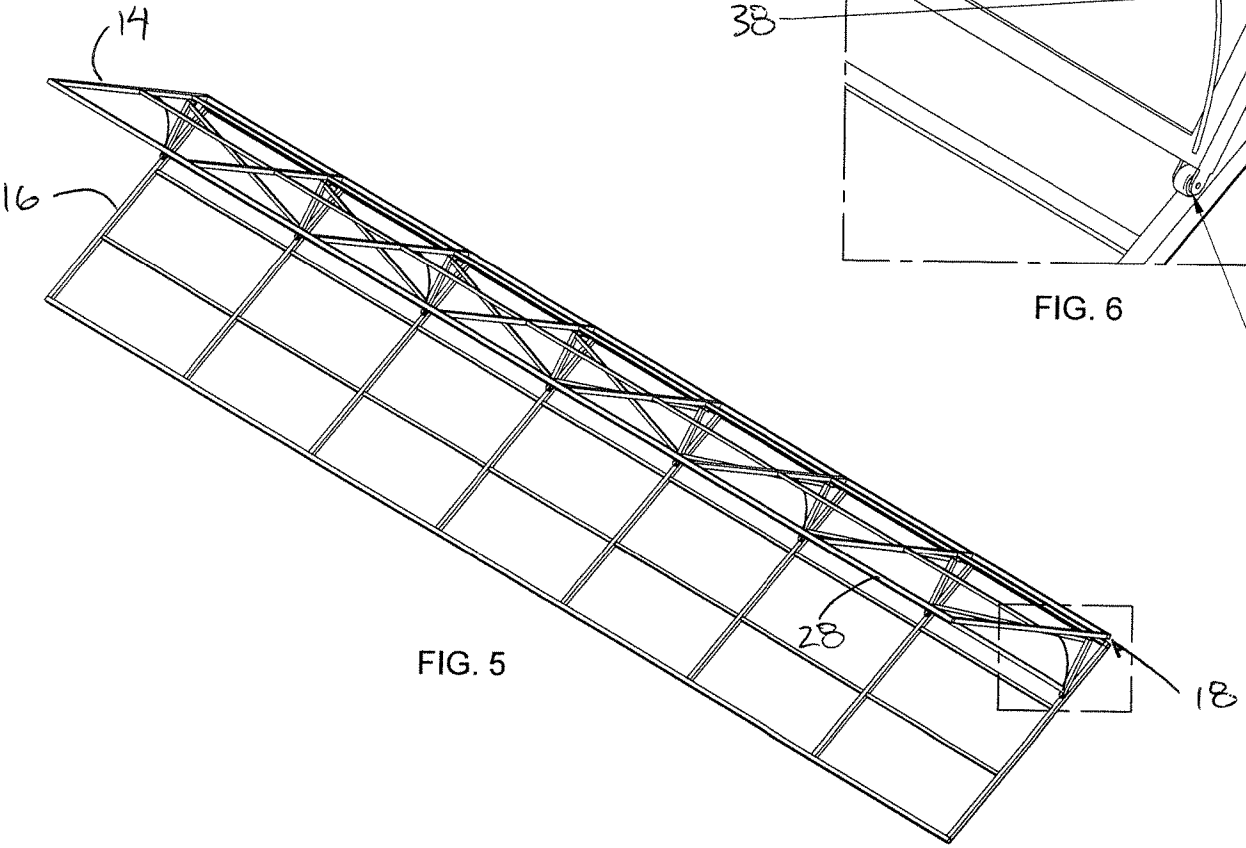
FIG. 5 is a perspective view of the bi-fold door assembly in a partially open position at 60 degrees from vertical including the folding truss according to the present invention supported thereon.
Figure 8:
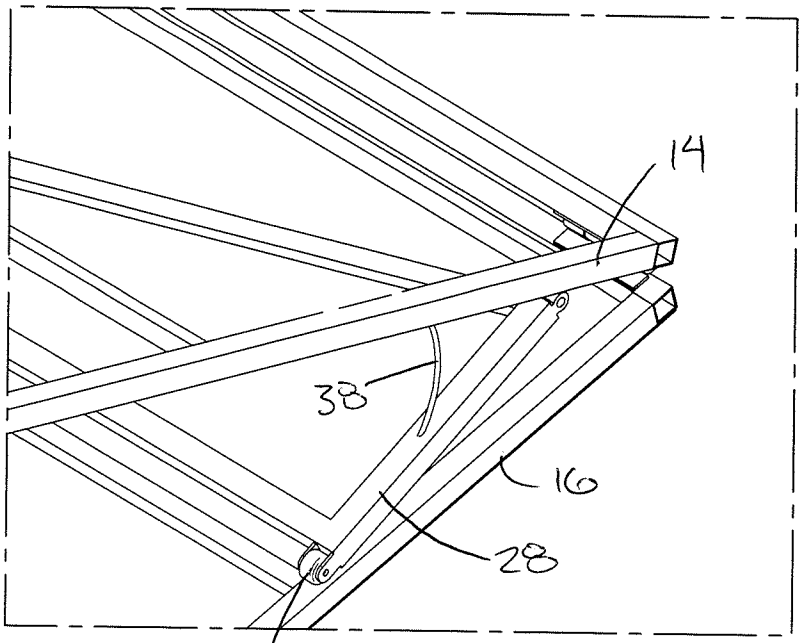
FIG. 8 is an enlarged portion of one of the hinges coupling the folding truss to the bi-fold door assembly in FIG. 7.
Figure 7:
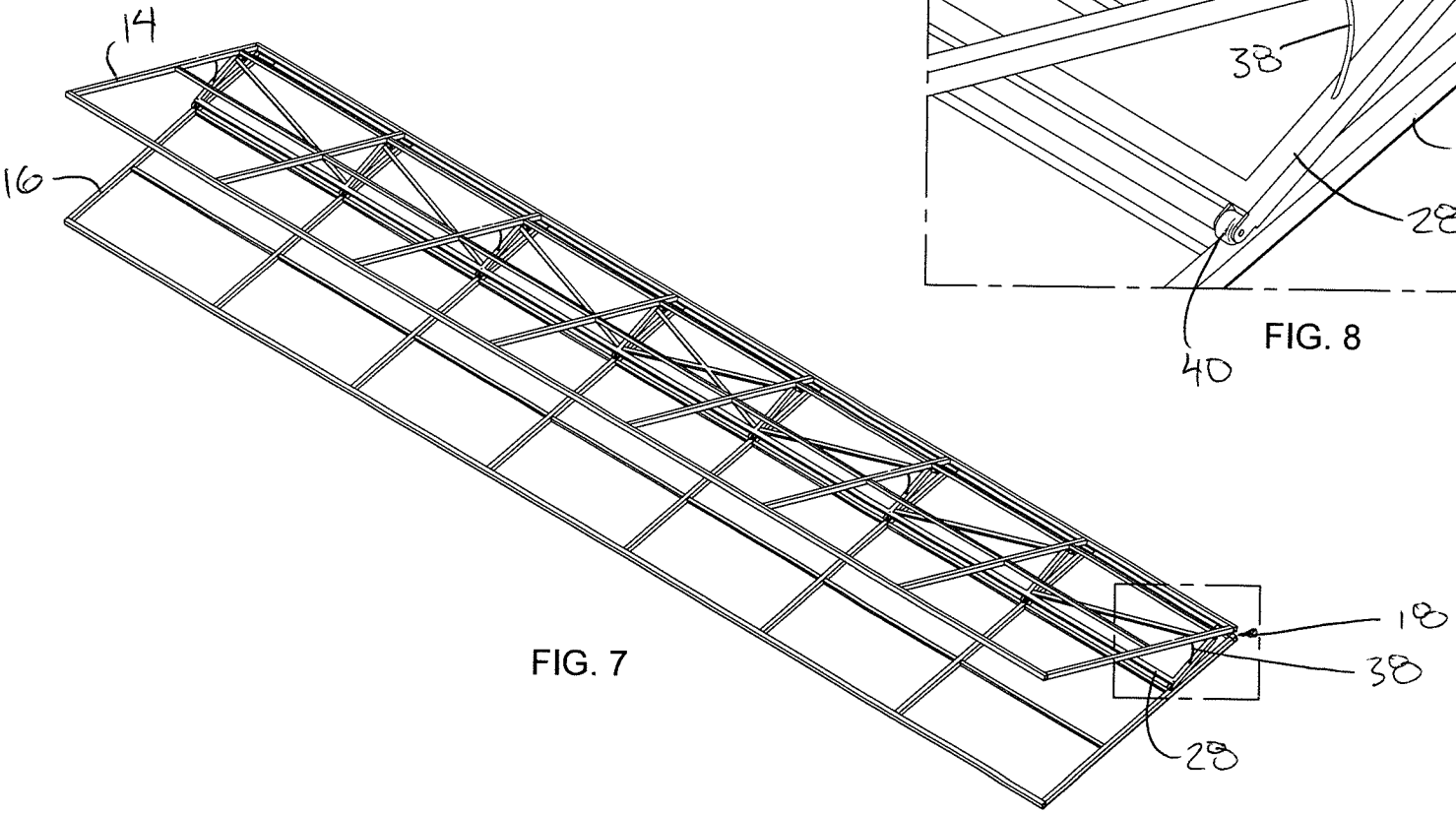
FIG. 7 is a perspective view of the bi-fold door assembly in an open position at 75 degrees from vertical including the folding truss according to the present invention supported thereon.

Referring to the accompanying figures there is illustrated a bi-fold door assembly generally indicated by reference numeral 10. The assembly 10 is supported within the door opening in a wall 12 of a building for operation between open and closed positions relative to the door opening in the conventional manner of a bi-fold door.

The assembly 10 includes an upper door section 14 for spanning an upper portion of the door opening in the closed position, and a lower door section 16 for spanning a lower portion of the door opening in the closed position. The upper door section 14 is pivotally coupled at the top end thereof relative to the wall 12 of the building at the top of the door opening for relative pivotal movement about a horizontal pivot axis. The lower door section is pivotally coupled at the top end thereof relative to the bottom end of the upper door section, also for relative pivotal movement about a horizontal pivot axis.

A plurality of hinge elements (not shown) couple the top end of the upper door section to the building. Similarly, plural hinge elements are coupled between the bottom end of the upper door section and the top end of the lower door section to collectively define a hinge about which the upper and lower door sections can be folded relative to one another between the open and closed position of the door assembly. In the closed position, the upper and lower door sections are coplanar with one another to fully span respective upper and lower portions of the door opening in the building.

In the open position, the upper door section is displaced upwardly and outwardly relative to the building so as to be sloped downwardly and outward from the building from the top end to the bottom end thereof at a slope of approximately 75° from vertical in the illustrated embodiment. The lower door section is displaced upwardly towards the upper door section into the open position such that the lower door section is sloped downwardly and inwardly from the bottom end of the upper door section back towards the building so that the bottom edge of the lower door section remains substantially within the plane of the door opening in the wall of the building. In the illustrated embodiment, the lower door section lies at a slope of approximately 75° from vertical forming an interior angle between the upper and lower door sections of approximately 30°.

Each of the upper and lower door sections comprises a planar frame including a top beam 20 spanning horizontally along the top edge of the section so as to span laterally across the full width of the door assembly and a bottom beam 22 spanning horizontally along the bottom edge of the section so as to span laterally across the full width of the door assembly. A plurality of uprights 24 are joined perpendicularly between the top beam and the bottom beam at spaced apart positions in the lateral direction across the full width. One or more cross members 26 are connected across all of the uprights 24 at an intermediate position along the height thereof so as to be located at respective vertically spaced positions between the top and bottom beams.

The hinge elements which collectively define the central hinge 18 are each formed of a pair of hinge leaves including a first leaf fixed to the bottom beam 22 of the upper door section 14 and a second leaf fixed to the top beam 20 of the lower door section 16 so that all of the hinge elements are pivotal about a common hinge axis of the door assembly.

The hinge elements which couple the upper door section to the building are similarly arranged to include a first leaf fixed to the header spanning across the top of the door opening on the building and a second leaf fixed to the top beam 20 of the upper door section 14 so that all of the hinge elements are pivotal about a common door axis of the door assembly.

The door assembly further includes a truss 28 supported on the inner side of the door assembly to protrude horizontally into the building in the closed position of the door. The truss 28 comprises a planar frame which is pivotally supported on the inner side of the upper door section near the central hinge 18 so as to be movable between a first position perpendicular to the upper door section in the closed position of the door assembly to resist bending of the door assembly, and a second position folded upwardly against the inner side of the upper door section away from the centre hinge so as to be closer to a parallel relationship with the upper door section than in the first position.

For example, in the illustrated embodiment, the plane of the frame of the truss 28 may be oriented near 30° relative to the plane of the upper door section when the upper door section is oriented 75° from vertical in the open position.

The truss 28 includes an outer chord 30 spanning the full width of the door assembly at the outer end of the truss farthest from the upper and lower door sections in the closed position. A plurality of primary web members 32 are oriented perpendicularly to the outer chord 30 in fixed relationship therewith such that each primary web member 32 extends from a hinge element 34 at the inner end thereof which pivotally couples the web member to a respective one of the uprights 24 of the upper door section to an outer end in fixed relation to the outer chord. One of the cross members 26 of the upper door section is connected between the uprights at the same elevation as the hinge elements 34 for added structural support at the mounting location of the truss 28 onto the upper door section.

In the illustrated example, a plurality of secondary web members 36 also extend from respective inner ends supported at the upper door section to respective outer ends fixed to the outer chord 30 of the truss, however, the secondary web members are sloped in a non-perpendicular relationship to the outer chord. More particularly each secondary web member is sloped in a direction towards a lateral center of the door assembly from an inner end of the secondary web member coupled to a respective primary web member 32 at the inner ends thereof to an outer end of the secondary web member which is fixed to the next adjacent primary web member 32 which is closest to the lateral centre of the door assembly. The space between the two primary web members 32 nearest to the lateral centre of the door assembly is occupied by two secondary web members 36 in an X-shaped pattern.

In further embodiments, the particular structure of the truss may vary. For example, the truss may use shear panels in place of secondary web members, or other combinations of web members may be used to provide the desired degree of resistant against bending.

The hinge elements at the inner end of the primary web members 32 collectively define an overall hinge which defines pivotal movement of the truss 28 relative to the upper door section about a common truss axis. The truss axis is parallel to the central hinge axis at a location spaced upwardly therefrom in the closed position of the door assembly. The width of the truss 28 between the inner ends of the primary web members and the outer chord at the outer end of the truss is approximately 3 to 4 times greater than the vertical height of the truss axis above the central hinge axis. In this manner, a relatively large truss can be located very near to the vertical centre of the overall door assembly to provide optimal resistance against bending in the closed position of the door.

To support the truss 28 in an optimal perpendicular relationship relative to the upper and lower door sections in the closed position, a plurality of flexible tension members 38 are coupled between the outer end of the truss 28 and a location on the upper door section spaced above the truss axis. More particularly each flexible tension member is coupled at a top end to a respective one of the uprights of the upper door section at a distance spaced above the truss axis which is approximately equal to the horizontal width of the truss between the inner and outer ends thereof so that the flexible tension members are sloped downwardly and outwardly from the door sections to the outer end of the truss at a slope of approximately 45° from vertical in the illustrated embodiment. The flexible tension members comprise a flexible cable or other suitable flexible link such as a foldable or bendable link so as to resist movement of the truss from the second position towards the first position, beyond the first position, yet the flexible tension members provide no interference or resistance to upward pivoting of the truss from the first position towards the second position.

A plurality of rollers 40 are also mounted on the outer end of the truss so that one roller 40 is provided in alignment with each primary web member of the truss, corresponding to alignment with each upright 24 of the lower door section. All of the rollers 40 are supported for rolling movement about a common roller axis which is horizontal so as to be parallel to the central hinge axis of the door assembly.

In operation, when the door is initially closed, the truss is suspended in perpendicular orientation protruding into the interior of the building from the inner end of the truss mounted on the inner side of the door sections to an outer end of the truss farthest from the door sections. The flexible tension members of the 38 support the truss in this first position while the door remains closed. As the door assembly is displaced towards the open position, the truss remains in the first position until the door is partially opened sufficiently that the rollers at the outer end of the truss engage respective uprights of the lower door section in an intermediate position of the door sections as shown in FIG. 13. As the door is continued to be opened and the upper door section is continued to be raised upwardly against the upper door section from the intermediate position of the door sections in FIG. 13 to the fully open position of the door sections shown in FIG. 15, the rollers roll along the uprights of the lower door section and the corresponding engagement of the lower door section with the truss urges the truss to be folded upwardly relative to the upper door section towards the inner side of the upper door section. The flexible nature of the tension members 38 do not interfere with this upward pivoting of the truss from the first position towards the second position thereof as the overall door assembly is pivoted towards the open position.

When closing the door assembly from the open position towards the closed position thereof, the upper and lower door sections are unfolded relative to one another and displaced towards the closed position in the usual manner of a bifold door assembly. The rollers remain engaged for rolling movement along respective uprights of the lower door section, causing the truss to be pivoted downwardly and away from the upper door section from the second position towards the first position thereof under force of gravity, until the door is partially closed in the orientation shown in FIG. 13. At this point, the truss assumes the perpendicular orientation of the first position thereof relative to the upper door section such that the flexible tension members support the truss relative to the upper door section and the continued closing of the door assembly disengages the rollers from the lower door section. The truss then simply remains in the first position until the door assembly is fully closed according to FIG. 9.

In further embodiments, the truss may be displaced relative to the door sections between the first and second positions by a linkage operatively connected between the door sections and the truss. In yet further embodiments, a powered actuator may be coupled between the truss and the respective door section upon which it is supported to positively drive the movement of the truss between the first and second positions thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A bi-fold door assembly for a door opening in a building, the assembly comprising:

an upper door section for being pivotally coupled at a top end of the upper door section to the building at a top of the door opening;

a lower door section;

a hinge pivotally coupling a top end of the lower door section to a bottom end of the upper door section such that the upper and lower door sections are movable between a closed position spanning the door opening and an open position in which the upper door section is oriented transversely to the door opening and an inner side of the lower door section is folded upwardly towards an inner side of the upper door section;

a truss pivotally supported along the inner side of one of the upper and lower door sections in proximity to the hinge;

the truss being pivotally movable relative to said one of the upper and lower door sections between a first position in which the truss stiffens the door assembly against bending corresponding to the closed position of the door sections and a second position in which the truss is reduced in overall width relative to said one of the upper and lower door sections in a direction which is normal to said one of the upper and lower door sections corresponding to the open position of the door sections; and a supporting member supporting the truss in the first position when the door assembly is in the closed position;

the truss being deployable from the second position to the first position responsive to displacement of the upper and lower door sections from the open position to the closed position without interference from the supporting member.

2. The bi-fold door assembly according to claim 1 wherein the truss is pivotal relative to said one of the upper and lower door sections about a truss axis oriented parallel to an axis of the hinge between the first position and the second position thereof.

3. The bi-fold door assembly according to claim 1 wherein the truss is supported on the upper door section.

4. The bi-fold door assembly according to claim 3 wherein the truss is folded upwardly towards the top end of the upper door section from the first position to the second position.

5. The bi-fold door assembly according to claim 1 wherein the supporting member is operatively connected between the truss and said one of the upper and lower door sections so as to be arranged to be supported under tension to restrict movement of the door assembly in the first position in a direction away from the second position without resisting displacement of the truss from the first position to the second position.

6. The bi-fold door assembly according to claim 1 wherein the truss is biased by gravity from the second position towards the first position in the closed position of the door sections.

7. The bi-fold door assembly according to claim 1 wherein the truss is urged from the first position to the second position by engagement with the other one of the upper and lower door sections as the door sections are folded towards the open position.

8. The bi-fold door assembly according to claim 7 further comprising a roller supported on the truss for rolling engagement along said other one of the upper and lower door sections to urge the truss from the first position to the second position.

9. The bi-fold door assembly according to claim 1 wherein the truss comprises an outer cord and a plurality of web members connected between the outer cord and said one of the upper and lower door sections, each web member being pivotally coupled relative to said one of the upper and lower door sections by a respective hinge element such that the truss is pivotal relative to the door sections between the first and second positions thereof.

10. The bi-fold door assembly according to claim 9 wherein the plurality of web members are connected between the outer cord and said one of the upper and lower door sections so as to be perpendicular to said one of the upper and lower door sections in the first position.

11. The bi-fold door assembly according to claim 1 wherein said overall width of the truss in the direction which is normal to said one of the upper and lower door sections is at least two times greater than a distance along said one of the upper and lower door sections between the truss and the hinge.

12. The bi-fold door assembly according to claim 1 wherein the truss spans most of a length of the door sections between opposing side edges of the bi-fold door.

13. The bi-fold door assembly according to claim 1 wherein the supporting member is operatively connected between the truss and the upper door section.

14. A bi-fold door assembly for a door opening in a building, the assembly comprising:

an upper door section for being pivotally coupled at a top end of the upper door section to the building at a top of the door opening;

a lower door section;

a hinge pivotally coupling a top end of the lower door section to a bottom end of the upper door section such that the upper and lower door sections are movable between a closed position spanning the door opening and an open position in which the upper door section is oriented transversely to the door opening and the lower door section is folded upwardly towards an inner side of the upper door section;

a truss pivotally supported along the inner side of a first door section among the upper and lower door sections;

the truss being pivotally movable relative to first door section between a first position in which the truss stiffens the door assembly against bending corresponding to the closed position of the door sections and a second position in which the truss is reduced in overall width relative to said first door section in a direction which is normal to said first door section corresponding to the open position of the door sections; and a supporting member supporting the truss in the first position when the door assembly is in the closed position, the supporting member allowing displacement of the truss from the first position to the second position;

the truss on the first door section being arranged to engage a second door section among the upper and lower door sections when the door sections are only partially opened in an intermediate position partway between the closed position and the open position; and the truss being movable from the first position to the second position responsive to displacement of the door sections from the intermediate position to the open position.

15. The bi-fold door assembly according to claim 14 wherein the supporting member is operatively connected between the truss and said first door section under tension to restrict movement of the door assembly in the first position in a direction away from the second position, and the supporting member being flexible such that the supporting member does not resist displacement of the truss from the first position to the second position.

16. The bi-fold door assembly according to claim 14 wherein said overall width of the truss in the direction which is normal to said first door section is at least two times greater than a distance along said first door section between the truss and the hinge.

17. The bi-fold door assembly according to claim 14 wherein the supporting member is operatively connected between the truss and the upper door section.

18. A bi-fold door assembly for a door opening in a building, the assembly comprising:

an upper door section for being pivotally coupled at a top end of the upper door section to the building at a top of the door opening;

a lower door section;

a hinge pivotally coupling a top end of the lower door section to a bottom end of the upper door section such that the upper and lower door sections are movable between a closed position spanning the door opening and an open position in which the upper door section is oriented transversely to the door opening and an inner side of the lower door section is folded upwardly towards an inner side of the upper door section;

a truss pivotally supported along the inner side of one of the upper and lower door sections in proximity to the hinge;

the truss being pivotally movable relative to said one of the upper and lower door sections between a first position in which the truss stiffens the door assembly against bending corresponding to the closed position of the door sections and a second position in which the truss is reduced in overall width relative to said one of the upper and lower door sections in a direction which is normal to said one of the upper and lower door sections corresponding to the open position of the door sections;

the truss being urged from the first position to the second position by engagement with the other one of the upper and lower door sections as the door sections are folded towards the open position; and a roller supported on the truss for rolling engagement along said other one of the upper and lower door sections to urge the truss from the first position to the second position.

19. The bi-fold door assembly according to claim 18 further comprising a supporting member operatively connected between the truss and said one of the upper and lower door sections under tension in the position so as to restrict movement of the door assembly in the first position in a direction away from the second position without resisting displacement of the truss from the first position to the second position.

20. The bi-fold door assembly according to claim 18 wherein said overall width of the truss in the direction which is normal to said one of the upper and lower door sections is at least two times greater than a distance along said one of the upper and lower door sections between the truss and the hinge.

* * * * *